US005147413A

United States Patent [19]

Kiovsky et al.

[11] Patent Number: 5,147,413

[45] Date of Patent: Sep. 15, 1992

[54] METHANOL FUEL CONTAINING FLAME LUMINOSITY AGENT

[75] Inventors: Thomas E. Kiovsky, Solon; Wendy L. Clark, Hudson, both of Ohio

[73] Assignee: The Standard Oil Company, Cleveland, Ohio

[21] Appl. No.: 382,902

[22] Filed: Jul. 20, 1989

[51] Int. Cl.[5] ..... C10L 1/22

[52] U.S. Cl. ..... 44/328; 44/389; 44/445; 44/451; 44/642

[58] Field of Search ..... 44/53, 59, 642, 328, 44/389, 445, 451

[56] References Cited

U.S. PATENT DOCUMENTS

| | | | |
|---|---|---|---|
| 3,049,533 | 8/1962 | Spitzer | 44/59 |
| 3,164,449 | 1/1965 | Buxbaum | 44/59 |
| 4,473,376 | 9/1984 | Hansen | 44/59 |
| 4,536,188 | 8/1985 | deWitt | 44/76 |
| 4,932,979 | 6/1990 | Thrasher et al. | 44/379 |

FOREIGN PATENT DOCUMENTS 0127316 5/1984 European Pat. Off. .

*Primary Examiner*—Margaret Medley

*Attorney, Agent, or Firm*—Michael F. Esposito; David J. Untener; Larry W. Evans

[57] ABSTRACT

The flame luminosity of a methanol fuel is appreciably enhanced by the addition thereto of at least one azo dye flame luminosity enhancing agent.

22 Claims, No Drawings

METHANOL FUEL CONTAINING FLAME LUMINOSITY AGENT

BACKGROUND OF THE INVENTION

This invention relates to a methanol fuel composition, in particular, one containing a flame luminosity agent.

One of the concerns of employing methanol as a motor vehicle fuel for which it has lately attracted a good deal of attention owing to environmental considerations is that it burns with a light blue flame which readily escapes notice, particularly in daylight or a well lighted area. Because methanol burns with a practically non-luminous flame, its use as a fuel presents a safety hazard which may deter its more widespread use. So, for example, during refueling or in a collision, a methanol-fueled fire might initially go unnoticed presenting a considerable hazard to those in its vicinity.

Nigrosine, an iron-containing azine dye, has been proposed for use as a luminosity agent for fuel which burns with a non-luminous flame. However, due to its heavy metal content, i.e., iron, it is entirely impractical as a luminosity agent for methanol which is intended to be used as a fuel for internal combustion engines. A combustion product of nigrosine, finely divided iron oxide particles, is quite abrasive and may result in an unacceptable rate of engine wear. In addition, fuel additives which contain heavy metals are known to deactivate emission control catalysts.

Another known approach to imparting or enhancing flame luminosity in a methanol-based fuel is to select the hydrocarbon composition of the primer. Such primers are added at 5 to 15 percent with the primary purpose of facilitating engine starting. They may contain gasoline, toluene or reformate. While such materials do provide flame luminosity, they detract from the clean-burning properties of methanol and, as noted in European Patent Application 0 127 316, can lead to problems of water sensitivity.

Another proposal for overcoming the problem associated with the non-luminous burning characteristics of methanol has been the use of 0.5 to 10.0 weight percent trimethyl borate flame luminosity agent as disclosed in U.S. Pat. No. 4,536,188. However, the environmental acceptability of boron-containing combustion products is at present uncertain and, in addition, the characteristic green color imparted to the flame may fail to convey the presence of a hot flame.

SUMMARY OF THE INVENTION

It is a principal object of the present invention to provide a methanol fuel composition containing a flame luminosity agent which is effective at low concentrations and whose combustion products are environmentally acceptable, do not cause catalyst deactivation and do not cause excessive engine wear as in the case of heavy metal-containing combustion products such as the iron oxides.

It is a specific object of the invention to provide such a methanol fuel composition in which the luminosity agent is an azo dye.

It is a further specific object of the invention to impart a distinctive color and taste to a methanol fuel composition to distinguish it from a potable liquid by the addition thereto of an azo dye.

It is still another specific object of the invention to impart enhanced flame luminosity to a methanol composition by the addition thereto of a small amount, e.g., 1 weight percent or less not exceeding the limits of solubility, of a monoazo, disazo and/or trisazo dye.

In keeping with these and other objects of the invention, a methanol fuel composition is provided which comprises methanol and a flame luminosity enhancing amount of at least one azo dye flame luminosity agent, the flame luminosity of the fuel composition during burning being appreciably enhanced relative to the flame luminosity of the untreated fuel.

DESCRIPTION OF THE PREFERRED EMBODIMENTS

The term "methanol fuel" as used herein shall be understood to include pure methanol, the various grades of methanol of commerce and mixtures of methanol and hydrocarbons.

The methanol fuel composition of this invention can be used for a variety of applications but is particularly useful as a fuel for operating an internal combustion engine of the spark ignition or compression ignition type.

The methanol fuel can, in addition to azo dye flame luminosity agent, contain small amounts of one or more other materials which are known to be useful in this type fuel, e.g., antioxidants, corrosion inhibitors, detergents, lubricity agents, octane improvers, etc. Typically, the total amount of such additives besides the azo dye luminosity agent will be less than about 1 weight percent based on the total volume of the composition. A combustion primer such as light hydrocarbon can be added to the methanol fuel composition of this invention where improved cold starting properties are desired. In most cases, from about 5 to about 15 weight percent primer based on the total weight of the methanol fuel composition can be used with good effect.

It can be advantageous in some cases to add the azo dye luminosity agent as a solution employing a carrier which is miscible in methanol. Suitable carriers include water; other monoalcohols such as ethanol, propanols, the butanols; polyhydroxyl alcohols such as ethylene glycol, propylene glycol, diethylene glycol, dipropylene glycol; polyoxyalkylene ether polyols such as the polyethylene glycols of up to about 2,500 average molecular weight, a polyester polyol, etc. The use of a carrier to incorporate the azo dye into the methanol fuel can assist in preventing or lessening the accumulation of azo dye residue on surfaces from which the methanol has evaporated, e.g., the interior surfaces of a carburetor or fuel injection system.

The azo dyes constitute a well-defined group of compounds characterized by the presence of one or more azo groups (—N=N—). The especially useful azo dyes where the present invention is concerned include monoazo, disazo and trisazo representatives of this class of compounds. Unlike nigrosine, the azo dye flame luminosity enhancing agents employed herein do not contain iron or other heavy metals which could result in excessive engine wear or interfere with operation of an internal combustion engine or any of its attendant systems such as a catalytic converter. In addition, the colors which azo dyes impart to the methanol are unobjectionable, certainly relative to nigrosine.

The azo dye selected for addition to methanol-based fuel in accordance with this invention must, of course, be incorporated therein in at least a flame luminosity enhancing amount. Ordinarily, the specific amount used should not exceed the limits of solubility of the azo dye for a particular methanol fuel composition and advantageously should only be that amount which is necessary to impart a reasonable level of enhanced visibility to the burning methanol flame. Simple and routine testing will readily determine the optimum quantity of azo dye to be used in a given methanol fuel composition. In most cases, the amount of azo dye which will provide an acceptable flame luminosity enhancing effect is from about 0.01 to about 1, preferably from about 0.02 to about 0.5, and most preferably from about 0.02 to about 0.1, weight percent of the total methanol fuel composition.

The following examples are illustrative of methanol fuel compositions in accordance with this invention.

EXAMPLES 1-11

The azo dyes shown in the table below were obtained from Aldrich Chemical Co., Milwaukee, Wisc. The dyes were dissolved in reagent grade methanol at the concentrations shown and the visibility of the flame was rated by visual observation. Five milliliters of each mixture was burned in a 5 centimeter diameter aluminum foil pan. The color of the resulting flames ranged from orange to yellow-orange.

TABLE

| Example | Azo Dye | Chemical Type | Concentration Wt. Percent |
|---|---|---|---|
| 1 | Mordant Brown 4 | monoazo | 0.10 |
| 2 | Bismark Brown R | disazo | 0.025 |
| 3 | Acid Orange 8 | monoazo | ca. 0.5 |
| 4 | Acid Yellow 38 | monoazo | 0.05 |
| 5 | Mordant Orange 1 | monoazo | 0.10 |
| 6 | Acid Blue 92 | monoazo | 0.10 |
| 7 | Mordant Yellow 12 | monoazo | ca. 0.50 |
| 8 | Acid Orange 51 | monoazo | ca. 0.50 |
| 9 | Acid Red 151 | disazo | ca. 0.50 |
| 10 | Methyl Orange | monoazo | 0.05 |
| 11 | Acid Blue 113 | disazo | ca. 0.50 |

What is claimed is:

1. A methanol fuel composition which comprises methanol and a flame luminosity enhancing amount of at least one azo dye flame luminosity enhancing agent, the flame luminosity of the fuel composition during burning being appreciably enhanced relative to the flame luminosity of the same burning fuel composition but to which no flame luminosity enhancing agent has been added.

2. The methanol fuel composition of claim 1 wherein the flame luminosity enhancing agent is present therein at a level of from about 0.01 to about 1 weight percent.

3. The methanol fuel composition of claim 1 wherein the flame luminosity enhancing agent is present therein at a level of from about 0.02 to about 0.5 weight percent.

4. The methanol fuel composition of claim 1 wherein the flame luminosity enhancing agent is present therein at a level of from about 0.02 to about 0.1 weight percent.

5. The methanol fuel composition of claim 1 wherein the azo dye is selected from the group consisting of monoazo dye, disazo dye and trisazo dye.

6. The methanol fuel composition of claim 1 wherein the azo dye is selected from the group consisting essentially of Mordant Brown 4, Bismark Brown R, Acid Orange 8, Acid Yellow 38, Mordant Orange 1, Acid Blue 92, Mordant Yellow 12, Acid Orange 51, Acid Red 151, Methyl Orange, Acid Blue 113 and mixtures of any two or more of the foregoing.

7. The methanol fuel composition of claim 1 wherein the azo dye does not contain, or is otherwise not associated with, a heavy metal component or heavy metal species.

8. The methanol fuel composition of claim 1 further comprising at least one other additive selected from the group consisting of corrosion inhibitor, detergent, antioxidant, lubricant, octane improver and combustion primer.

9. The methanol fuel composition of claim 1 further comprising a carrier for the azo dye.

10. The methanol fuel composition of claim 1 further comprising a carrier for the azo dye selected from at least one of water, ethanol, propanols, butanols, polyhydroxyl alcohols and polyoxyalkylene ether polyols.

11. The methanol fuel composition of claim 10, wherein said polyhydroxyl alcohols include at least one of ethylene glycol, propylene glycol, diethylene glycol and dipropylene glycol, and said polyoxyalkylene ether polyols include at least one of polyethylene glycols of up to about 2,500 average molecular weight, and a polyester polyol.

12. A method for enhancing the flame luminosity of a methanol fuel which comprises adding tot he methanol fuel a flame luminosity enhancing amount of at least one azo dye flame luminosity enhancing agent, the flame luminosity of the methanol fuel during burning being appreciably enhanced relative to the flame luminosity of the same burning methanol fuel but to which no flame luminosity enhancing agent has been added.

13. The method of claim 12 wherein the flame luminosity enhancing agent is added to the methanol fuel at a level of from about 0.10 to about 1 weight percent.

14. The method of claim 12 wherein the flame luminosity enhancing agent is added to the methanol fuel at a level of from about 0.02 to about 0.5 weight percent.

15. The method of claim 12 wherein the flame luminosity enhancing agent is added to the methanol fuel at a level of from about 0.02 to about 0.10 weight percent.

16. The method of claim 12 wherein the azo dye is selected from the group consisting of monoazo dye, disazo dye and trisazo dye.

17. The method of claim 12 wherein the azo dye is selected form the group consisting essentially of Mordant Brown 4, Bismark Brown R, Acid Orange 8, Acid Yellow 38, Mordant Orange 1, Acid Blue 92, Mordant Yellow 12, Acid Orange 51, Acid Red 151, Methyl Orange, Acid Blue 113 and mixtures of any two or more of the foregoing.

18. The method of claim 12 wherein the azo dye does not contain, or is otherwise not associated with, a heavy metal component or heavy metal species.

19. The method of claim 12 further comprising the addition of at least one other additive selected from the group consisting of corrosion inhibitor, detergent, antioxidant, lubricant, octane improver and combustion primer.

20. The method of claim 12 further comprising the addition of a carrier for the azo dye.

21. The method of claim 12 further comprising the addition of a carrier for the azo dye selected from at least one of water, ethanol, propanols, butanols, polyhydroxyl alcohols and polyoxyalkylene ether polyols.

22. The method of claim 21, wherein said polyhydroxyl alcohols include at least one of ethylene glycol, propylene glycol, diethylene glycol and dipropylene glycol, and said polyoxyalklene ether polyols include at least one of polyethylene glycols of up to about 2,500 average molecular weight, and a polyester polyol.

* * * * *